United States Patent [19]

Hapgood

[11] 3,975,137

[45] Aug. 17, 1976

[54] BURNER CONTROL SYSTEM

[75] Inventor: William H. Hapgood, Concord, Mass.

[73] Assignee: Raytheon Company, Lexington, Mass.

[22] Filed: Feb. 3, 1975

[21] Appl. No.: 546,243

Related U.S. Application Data

[60] Continuation-in-part of Ser. No. 49,645, June 25, 1970, abandoned, which is a division of Ser. No. 10,334, Feb. 11, 1970, Pat. No. 3,704,748, which is a continuation-in-part of Ser. No. 737,135, June 14, 1968, abandoned, which is a continuation-in-part of Ser. No. 700,192, Jan. 24, 1968, abandoned.

[52] U.S. Cl. ..... 431/79; 431/66

[51] Int. Cl.[2] ..... F23N 5/08

[58] Field of Search ..... 431/78, 79, 80, 66

[56] References Cited

UNITED STATES PATENTS

| | | | |
|---|---|---|---|
| 2,840,146 | 6/1958 | Ray | 431/79 |
| 3,537,804 | 11/1970 | Walbridge | 431/79 X |
| 3,741,709 | 6/1973 | Clark | 431/79 |
| 3,770,365 | 11/1973 | Lenski | 431/79 |

*Primary Examiner*—Edward G. Favors

*Attorney, Agent, or Firm*—Joseph D. Pannone; Milton D. Bartlett; Herbert W. Arnold

[57] ABSTRACT

A burner control circuit in which the flame of a high capacity burner is ignited by a spark or hot wire and ignition is sensed by a photocell positioned outside the flame and controlling a semiconductor current amplifier which controls the current in a series path through the solenoid of a fuel valve, a thermal time delay relay and a bridge rectifier energized by a transformer winding. The relay opens the series circuit a predetermined time after the transformer has been energized if ignition has not been achieved. The system using the burner is a high capacity heater having the burner positioned inside a plenum of an extended surface heat exchanger for heating a fluid to supply to a second heat exchanger, and energization of the control circuit for the ignition and flame sensing is controlled by the heat required by the first and/or second heat exchangers.

10 Claims, 4 Drawing Figures

BURNER CONTROL SYSTEM

CROSS-REFERENCE TO RELATED APPLICATIONS

This is a continuation in part of application Ser. No. 49,645 filed June 25, 1970 (now abandoned), which is a division of application Ser. No. 10,334 filed Feb. 11, 1970 (now U.S. Pat. No. 3,704,748), which is a continuation-in-part of application Ser. No. 737,135 filed June 14, 1968 (now abandoned), which is a continuation-in-part of application Ser. No. 700,192 filed Jan. 24, 1968 (now abandoned).

BACKGROUND OF THE INVENTION

U.S. Pat. No. 3,663,150 issued May 16, 1972 to William H. Hapgood discloses a system for controlling the fuel valve for a high capacity burner in which a sensor of material having a high positive temperature coefficient of electrical resistance is used to sense the presence of a flame following energization of a hot wire igniter and a fuel valve. Such a system performs satisfactorily when the time delay for closing the gas valve in the event of ignition failure is sufficiently long and/or the impedances of the fuel valve solenoid winding and time delay resistor are specially selected. However, where higher performance boilers require quicker response between the application of the fuel and the breaking of the circuit in the event of ignition failure or where standard solenoid windings and time delay relays are desired, current amplification of the flame sensor output is desirable.

SUMMARY OF THE INVENTION

In accordance with this invention, a system is disclosed in which reliable ignition and ignition flame sensing can be achieved with a hot wire igniter and an optical sensing device positioned outside the flame but in proximity thereto so that a very intense flame may be used without damage to the ignition or sensing system. Briefly, this system comprises a heat exchange system in which a fuel-air mixture is fed to a burner comprising a plurality of ports by a blower at a pressure which produces a flame during combustion which extends continously across the region between the ports, and the base of the flame is lifted from the ported surface so that relatively little heat is transferred to the burner surface, and the radiant energy of the flame being relatively low in the infrared region permits low temperature metals to be used for the burner surface. An igniter such as, for example, a hot wire of super Kanthol is positioned adjacent to the burner flame which preferably is formed by combustion of a fuel-air mixture from a plurality of individual ports at velocities and spacings producing flame jets merging to produce a continuous flame front. The fuel-air mixture issuing from the ports extends to the hot wire igniter prior to ignition and upon ignition by the hot wire withdraws to a flame front spaced from the burner.

Upon ignition the flame is sensed by an optical sensor such as a cadmium sulfide photoconductive cell controlling a semiconductor current amplifier whose output is in series with a fuel valve solenoid supplying fuel to the burner, a thermal time delay circuit breaker, and a source of undirectional time varying voltage such as a bridge rectifier fed by a transformer. The transformer is energized by a control circuit controlled by the temperature desired by a heat exchanger or heat exchangers supplied with thermal energy by the burner. Such a system provides a fail-safe mode of operation and allows standard components for the circuit breaker and the gas valve to be selected since the magnitude of current through the thermally actuated circuit breaker is set predominantly by the bias on the semiconductor amplifier which is controlled by the magnitude of the control resistor in series with the optical sensor. Since the optical sensor responds substantially instantaneously to the presence or absence of flame, the control of the time delay is substantially entirely within the control of the change of current of the amplifier and, therefore, standard circuit breaker components commercially available can be used. As a result, a reliable inexpensive ignition and flame sensing system for controlling a high intensity burner heat exchanger is achieved with high reliability, low cost components.

BRIEF DESCRIPTION OF THE DRAWINGS

Other and further advantages of the invention will be apparent as the description thereof progresses, reference being had to the accompanying drawings wherein.

DESCRIPTION OF THE PREFERRED EMBODIMENT

Figure 1:
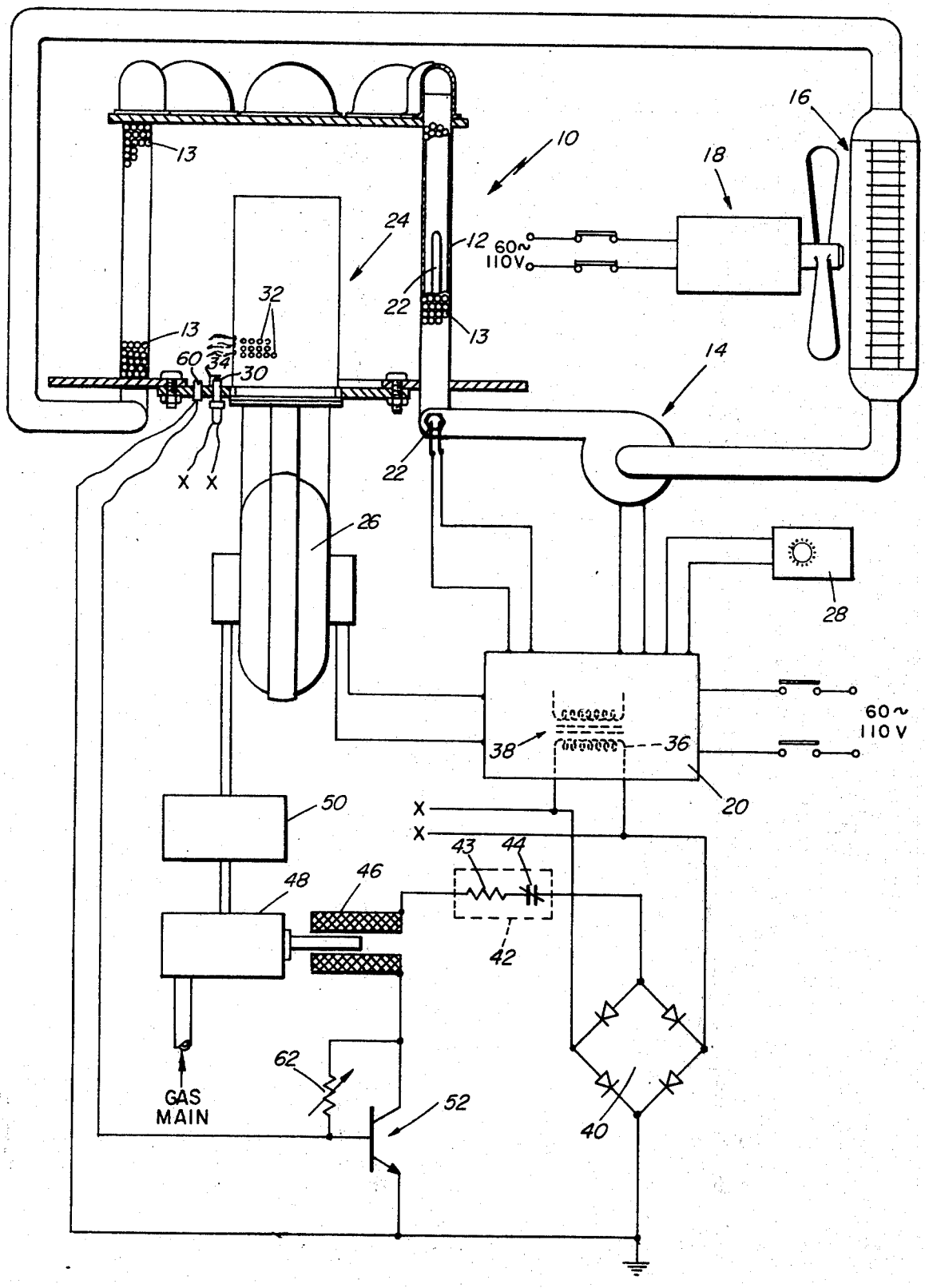
FIG. 1 illustrates a control circuit for a burner for a high performance heat exchanger system embodying the invention.

Referring now to FIG. 1, there is shown a heat exchanger 10 comprising a plurality of vertical tubes 12 arranged with their axes around a central plenum rigidly interconnected by a plurality of thermally conductive members 13 to form an extended surface high temperature heat exchanger through which a fluid, such as water, is circulated by means of a motor driven pump 14. Pump 14 also circulated the fluid through a second heat exchanger 16 which may be a conventional finned radiator located in a region where it is desired to supply thermal energy to an air space, such as a home. A motor driven fan 18 is positioned adjacent thereto for directing air through the regions between the fins of heat exchanger 16. While the motor of fan 18 as shown here is run continuously, it may, if desired, be controlled by means of a thermostat in the air space, or be controlled by any other desired means, to energize fan 18 when heat is desired in the space to be heated.

The motor of pump 14 is controlled by a control system 20 which may sense the temperature of the fluid in second heat exchanger 16, for example, by means of a sensor 22 on the heat exchanger 10 to energize the circulating pump 14 whenever the temperature of the fluid is above a predetermined level such as, for example, 120°F as determined by the sensor 22 which may be, for example, a temperature sensing rod extending into one of the tubes 12.

Energy is supplied to the heat exchanger 10 by means of a burner structure 24 which is supplied with a fuel-air mixture from a blower 26. In order to ignite the fuel of burner 24, a hot wire igniter 30 is positioned slighly below the lowest row of ports 32 in the burner 24. The fuel-air mixture first extends into the region of the igniter and upon ignition, the flame moves back from the igniter. A shielding member 34 prevents radiation from the flame from impinging directly on the hot wire ignition member 30 and thereby avoids overheat and burnout of this element.

As illustrated herein, igniter 30 is connected directly across the secondary winding 36 of a transformer 38 in control system 20 whose primary winding is energized when a thermostat 28 in the air space to be heated by heat exchanger 16 calls for heat. Control unit 20 is energized by a source of power, such as a 110V 60-cycle power line.

Transformer winding 36 also energizes bridge rectifier 40 which produces a DC output having a predominant 120-cycle component superimposed thereon. Bridge rectifier 40 is connected in series with a thermally operated time delay circuit 42, the solenoid 46 of a gas valve 48, and a transistor 52. The emitter of transistor 52 is preferably connected to ground as well as to the other side of the bridge rectifier from that connected to thermal time delay 42.

A photoconductive element 60, such as a cadmium sulfide photocell, is positioned outside the flame region of the burner 24 and in a position to sense the flame, and preferably is isolated from radiation from the ignition element 30, for example, by the shield 34. Element 60 is connected between the base of the transistor 52 and its emitter which is grounded. A control resistor 62 is connected between the base of transistor 52 and its collector which is connected to solenoid 46 so that the transistor 52 will be controlled by the voltage produced by the voltage divider network comprising the resistor 62 and the resistance of the photoconductive element 60.

Figure 2:
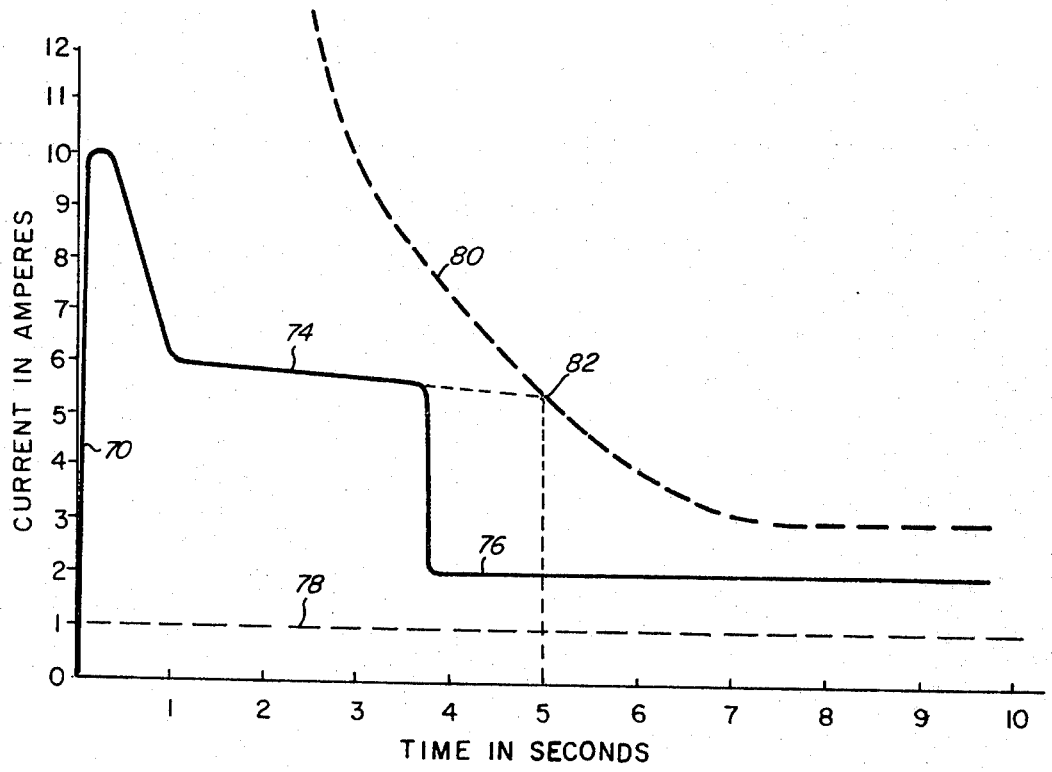
FIG. 2 illustrates a timing diagram showing the ignition sequence.

Referring now to FIGS. 1 and 2, the operation of the flame sensing circuit will be described. Plotted along the vertical axis of the graph of FIG. 2 is the average current through the time delay element 42 and the solenoid 46 while plotted along the horizontal axis is time in seconds. When the thermostat 28 calls for heat, the control system 20 energizes transformer 36 supplying the hot wire ignition element 30 with 60-cycle power via the connections labeled X—X in FIG. 1 at a voltage of, for example, approximately 4 volts rms or 5½ volts peak. The output of the bridge rectifier 40 has a voltage waveform, as shown in FIG. 1, of rectified AC having a peak of about 5½ volts and a predominant AC component of 120 cycles. Since the photoconductive element 60 is not sensing light from the flame, the resistance thereof is high compared to the resistor 62, and transistor 52 presents low resistance which may be substantially a short circuit from the collector to the emitter. By selecting the value of the resistor 62, transistor 52 may present any desired resistance to the circuit at this time. The current through solenoid 46 risses rapidly from zero when power is supplied to the transformer 36 as shown by curve 70 in FIG. 2 to a high value of, for example, 10 amperes due to the low impedance of transistor 52 and the fact that solenoid 46 having been deenergized has the core members partially withdrawn by the solenoid and presents relatively low inductance to the circuit as shown by point 72 of the curve limited primarily by the resistance of resistive element 44 and the resistance of the solenoid 46.

As the solenoid 46 is actuated, its inductance increases due to movement of the magnetic actuating element into the core. The inductive reactance change to the 120-cycle component of the voltage output from the bridge rectifier is longer than it would be for 60 cycles. For example, with standard components, current through the solenoid value 48 preferably drops from 10 amperes to a value of 7 or 8 amperes shown by the region 74 of the curve and thereafter in the absence of a flame in the burner drops slightly due to the increasing resistance from heating of the resistor 43 in series with normally closed contacts 44 in the thermal time delay 42. Upon ignition, the photoconductor 64 drops rapidly in resistance in response to detected radiation from the flame to a value preferably much lower than resistor 62 thereby reducing the value of the current through the transistor 52 to a low value of, for example, two amperes as shown by the portion 76 of the curve which is above the value of one ampere as shown by the dotted line 78 required to maintain the solenoid energized sufficiently to maintain valve 48 open against a conventional spring bias (not shown) which closes the valve when current through the solenoid 46 is interrupted. In the event that ignition does not occur, the current through the resistor 43 will heat a conventional bimetallic element (not shown) to open the contacts 44 after a predetermined time. For example, the curve 80 shows range of currents and times where contacts 44 open. The point 82 indicates where the current of the curve 70 would cross the current time curve of the thermal time delay device 42 in the absence of a flame, at which time contacts 44 open and valve 48 closes. Since by the use of the transistor 52 a wide range of components 46 and elements 40 may be used with a relatively wide tolerance of applied voltages 36, this circuit may be used with standard commercial valves and thermally actuated time delays. The curve 80, as illustrated herein, is illustrative of a thermal time delay device 42 selected to remain with contacts 44 closed at a current average less than, for example, 4 amperes so that the flame sensed curve portion 76 at 2 amperes while the burner is in operation will not actuate the device 42 while at the same time providing current through the solenoid 46 sufficiently in excess of the one ampere required to maintain the valve 48 open so that a margin of safety is provided against erratic operation.

The curcuit illustrated is stable and independent of a wide range of voltage variations. For example, the voltage from transformer 38 must double or half for the current portion 76 through the transistor 52 to cross curves 78 or 82 to shut down the burner. Stabillity may, in practice, be further enhanced by using a transformer 38 which has some leakage reactance and is, hence, inexpensive.

The voltages and currents disclosed herein are by way of example only and any desired range of voltages and currents could be used, and additional resistors can be inserted in shunt or in series with element 60 to set the level of current portions 74 and 76 at any desired values.

In addition, by changing the value of the resistor 43, the location of curve 80 may be shifted to increase or decrease the time following energization of the transformer 38 at which the contact 44 opens to shut down the fuel valve.

A shutdown sensing signal may be fed by means of a connection 53 from the junction between delay 40 and the solenoid 46 to the control system to deenergize the blower motor 26 and/or other elements of the system.

Following a period of time, such as a minute or so, from the burner start, the fluid in the heat exchanger 10 will have been raised to a sufficient temperature to actuate the thermal sensor 22 to circulate the fluid through the heat exchanger 16 by actuation of pump 14.

An additional feature of safety may be introduced by utilizing the pressure regulator 50 as a zero pressure regulator such that the gas pressure at the output of the regulator is supplied to the blower slightly below atmospheric pressure. Thus, if the blower 26 motor is not actuated due, for example, to motor failure or a malfunction of control circuit 20, no gas will be supplied to the inlet of the blower 26 since the blower 26 must be operating to produce a slight vacuum at its inlet. In addition, variations in blower volume will automatically produce variations in the gas input to maintain the fuel-air mixture ratio substantially constant over a substantial range of burner conditions.

The circuit is an electrically fail-safe circuit since in the event the transistor 52 punches through (shorting the collector to the emitter), the current drawn will no longer be controlled by the base and the thermal time delay will open the contacts 44. Preferably, the thermal time delay unit 42 is the standard unit which once actuated must be manually reset to close the contacts 44. In the event that one of the contacts, such as the base emitter or collector of the transistor, becomes open-circuited, the solenoid 46 is deenergized and the valve 48 closes. Also, a similar result occurs in the event of burnout of the resistors 62 or 43 which open-circuit such resistors in their failure mode. Since the currents through transistor 52 may be altered by altering the size of the resistor 62 to alter both the current level 76 and the current level 74 to make each current, for example, one-half or twice as much as those stated, this resistor may be selected for the particular solenoid 46 and resistor 43 used with the unit. If desired, the resistor 62 may be made a variable resistor (as shown) which is set as a factory adjustment and sealed at the factory or, alternatively, the resistor 62 may be adjusted in the field in accordance with installation instructions. Since it is necessary for high performance burners to have relatively short time delays, it is necessary to amplify the relatively small signal passed by a high speed sensor such as the optical element 60 to provide sufficient power to actuate mechanical devices such as the valve 48. The circuit will operate with a wide range of input sensor types and with changes in optical sensor characteristics due, for example, to dirt buildup on the sensor 60 which may be replaced in the field while still retaining operation of the system within limits specified by public safety regulations.

When the thermostat 28 no longer calls for heat, the transformer 38 is deenergized, closing valve 48 and shutting down the burner 24. However, circulating pump 22 continues to run until the temperature in the heat exchanger 10 has been reduced below a predetermined value, such as 100°F, to avoid localized overheating of the heat exchanger 10.

Figure 3:
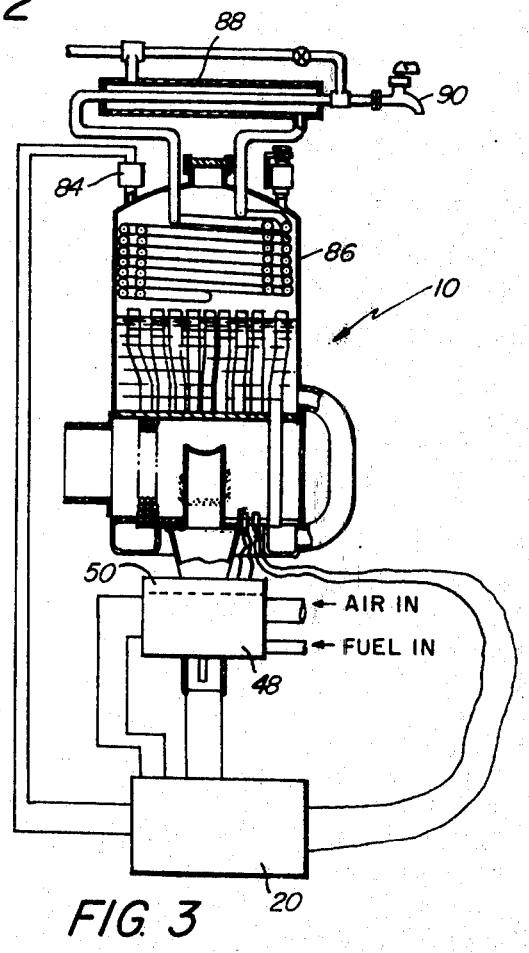

Referring now to FIG. 3, there is shown a version of the invention in which the burner supplies steam to a second heat exchanger through which water may be drawn for a hot water tap. In this system, the burner is pressure actuated by a pressure switch 84 to maintain a pressure of, for example, between 5 and 10 pounds on a steam dome 86 on heat exchanger 10 supplying steam to a hot water heat exchanger 88. Since the steam is over 200°F, a mixing valve and heat exchanger 88 is used to supply the desired temperature of water at the output 90.

Figure 4:
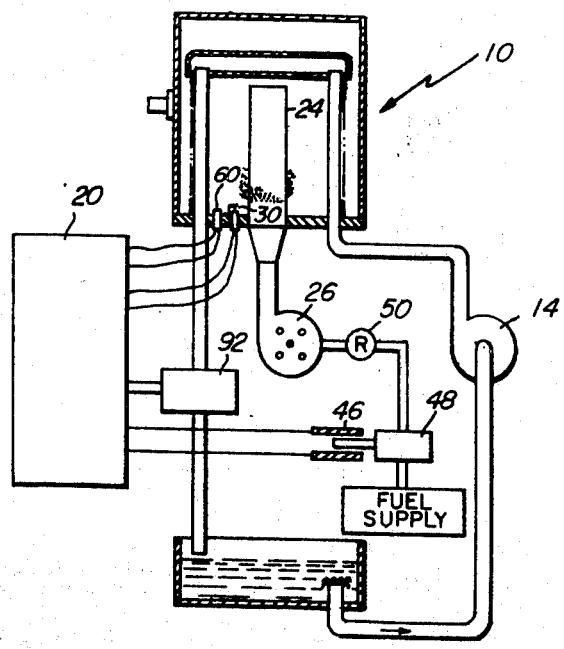
FIGS. 3 and 4 illustrate alternate embodiments of systems utilizing the invention.

Referring now to FIG. 4, there is shown a version of the invention in which a deep fat fryer has the oil heated directly through the heat exchanger 10, and the circulating pump 14 is run continously while the temperature of the oil at the output of the heat exchanger 10 is sensed by a sensor 92 to determine the temperature at which the burner will shut down by deenergization of the control circuit 20. Such a system permits accurate temperature control of the oil without hot spots in the heat exchanger 10 damaging the oil by overheating.

This completes the embodiments of the invention disclosed herein. However, many modifications thereof will be apparent to persons skilled in the art. For example, other amplifiers may be substituted for the transistor 52, other sensors may be substituted for the optical sensor 60, and a wide variety of ignition devices such as spark devices may be used in place of the particular hot wire igniter 80. Also, many mechanical configurations of the burner heat exchanger structure and heat transfer structures may be used without departing from the spirit and scope of this invention. Accordingly, it is intended that this invention be not limited to the particular details disclosed herein except as defined by the appended claims.

What is claimed is:

1. A heating system comprising:

a burner positioned in a central plenum defined by an extended surface heat exchanger;

optical sensing means for producing a control signal in response to the presence of a flame; and variable impedance means responsive to said sensing means for controlling the current through a series connected fuel control valve solenoid, thermal time delay means, and a source of electrical energy.

2. The heating system in accordance with claim 1 wherein said current controlling means comprises semiconductor means responsive to said optical sensing means and controlling the current through said solenoid.

3. The heating system in accordance with claim 2 wherein said semiconductor means comprises a transistor.

4. The heating system in accordance with claim 1 wherein said source of electrical energy comprises a transformer winding supplying a bridge rectifier.

5. A heating system comprising:

a burner positioned in a central plenum defined by an extended surface heat exchanger;

burner control means comprising optical sensing means responsive to the presence of a flame and controlling means for controlling the current through a series connected fuel control valve solenoid, thermal time delay means, and a source of electrical energy; and said burner being supplied with a fuel-air mixture from a blower whose input is supplied with said fuel from said valve through a pressure regulator which supplies gaseous fuel to the input of said blower at pressures below atmospheric pressure.

6. In combination:

a burner;

a blower supplying said burner with a mixture of gaseous fuel and air;

a solenoid controlled valve supplying the input of said blower with said gaseous fuel through a pressure regulator; and a control system for said burner comprising means for igniting said burner, sensing the presence of said ignition, and controlling the input of a semiconductor current amplifier in accordance with said sensing to vary the current through said amplifier and through said solenoid and a thermal time delay relay connected in series with said amplifier to open said series circuit a predetermined time after energization thereof when lack of a sensed signal indicates the absence of a flame at said burner.

7. The combination in accordance with claim 6 wherein said semiconductor amplifier comprises an emitter, a collector, and a base electrode being connected to an optical sensor for sensing said burner flame.

8. The combination in accordance with claim 7 wherein said base electrode is connected to said collector electrode through a control resistor and said base electrode is connected to said emitter electrode through said optical sensor whose resistance is reduced in the presence of radiation from said flame.

9. The combination in accordance with claim 8 wherein said series circuit is supplied with electrical energy from a source of power having a direct current component and an alternating current component.

10. The combination in accordance with claim 9 wherein said source of power comprises a transformer feeding a bridge rectifier.

* * * * *